US009669526B2

(12) United States Patent
Ely

(10) Patent No.: US 9,669,526 B2
(45) Date of Patent: Jun. 6, 2017

(54) TOOLS WITH SOCKET RETAINERS

(71) Applicant: Ingersoll-Rand Company, Davidson, NC (US)

(72) Inventor: Sean C. Ely, Flemington, NJ (US)

(73) Assignee: Ingersoll-Rand Company, Davidson, NC (US)

( * ) Notice: Subject to any disclaimer, the term of this patent is extended or adjusted under 35 U.S.C. 154(b) by 715 days.

(21) Appl. No.: 14/149,019

(22) Filed: Jan. 7, 2014

(65) Prior Publication Data

US 2015/0190909 A1 Jul. 9, 2015

(51) Int. Cl.

| | |
|---|---|
| ***B25B 13/06*** | (2006.01) |
| ***B25B 23/00*** | (2006.01) |
| ***B25B 21/02*** | (2006.01) |

(52) U.S. Cl.

CPC ..... *B25B 23/0035* (2013.01); *B25B 21/02* (2013.01); *B25B 21/026* (2013.01); *B25B 13/06* (2013.01)

(58) Field of Classification Search

CPC ..... B25B 13/06; B25B 23/0057
USPC ..... 173/93
See application file for complete search history.

(56) References Cited

U.S. PATENT DOCUMENTS

| | | | | |
|---|---|---|---|---|
| 2,160,150 | A | 5/1939 | Jimerson et al. | |
| 2,745,528 | A | 5/1956 | Amtsberg | |
| 2,801,718 | A | 8/1957 | Kaman | |
| 3,180,435 | A | 4/1965 | McHenry | |
| 3,661,217 | A | 5/1972 | Maurer | |
| 3,734,515 | A | 5/1973 | Dudek | |
| 3,804,180 | A | 4/1974 | Gelfand et al. | |
| 4,460,049 | A | 7/1984 | Shibata | |
| 5,050,467 | A * | 9/1991 | Brown | B25B 23/0035 403/325 |
| 5,390,571 | A * | 2/1995 | Fox, III | B25B 23/0021 403/325 |
| 5,531,140 | A * | 7/1996 | Chow | B25B 23/0035 403/325 |
| 5,595,099 | A | 1/1997 | Pusateri | |
| 5,630,342 | A | 5/1997 | Owoc | |
| 5,660,491 | A * | 8/1997 | Roberts | B25B 15/001 403/322.1 |
| 6,062,112 | A * | 5/2000 | Bonniot | B25B 23/0021 403/328 |

(Continued)

OTHER PUBLICATIONS

Ingersoll-Rand Company, 259 Air Impactool Exploded View, May 2010, 2 pages.

*Primary Examiner* — Gloria R Weeks
(74) *Attorney, Agent, or Firm* — Barnes & Thornburg LLP

(57) ABSTRACT

In at least one illustrative embodiment, a tool may comprise an output shaft configured to rotate about an axis, the output shaft including a socket mount having a tip and a solid root, and a socket retainer including (i) a retaining pin coupled to the tip of the socket mount and configured to move perpendicularly to the axis between a releasing position in which the retaining pin is located entirely within a first space formed in the tip and a retaining position in which the retaining pin extends outwardly through a first aperture formed in the tip and opening to the first space and (ii) a release pin coupled to the tip of the socket mount and configured to move along the axis to cause the retaining pin to move between the releasing position and the retaining position.

18 Claims, 6 Drawing Sheets

(56) References Cited

U.S. PATENT DOCUMENTS

| | | | | |
|---|---|---|---|---|
| 6,327,941 | B1 * | 12/2001 | Cheng | B25B 23/0021 81/177.1 |
| 6,672,183 | B2 * | 1/2004 | Johnson | B25B 23/0035 81/177.85 |
| 6,889,582 | B2 * | 5/2005 | Wilhelm | B25B 23/0035 403/322.2 |
| 7,036,406 | B2 * | 5/2006 | Milbourne | B25B 15/001 173/93.5 |
| 7,225,709 | B2 * | 6/2007 | Liao | B25B 23/0035 81/177.2 |
| 7,249,638 | B2 | 7/2007 | Bodine et al. | |
| 7,562,720 | B2 | 7/2009 | Seith et al. | |
| 8,667,872 | B2 * | 3/2014 | McCullough | B25B 23/0021 81/177.2 |
| 8,667,875 | B2 * | 3/2014 | Haman | B25B 21/02 279/76 |
| 8,733,215 | B1 * | 5/2014 | Kravitch | B25B 13/48 81/177.2 |
| 8,839,879 | B2 * | 9/2014 | Elger | B25B 21/02 173/128 |
| 9,364,942 | B2 * | 6/2016 | Puzio | B25B 21/02 |
| 2002/0060082 | A1 | 5/2002 | Watanabe | |
| 2002/0152848 | A1 | 10/2002 | Johnson | |
| 2005/0022638 | A1 | 2/2005 | Milbourne et al. | |
| 2005/0279196 | A1 | 12/2005 | Hollar | |
| 2007/0186729 | A1 | 8/2007 | Baker | |
| 2010/0064864 | A1 | 3/2010 | Kobayashi | |
| 2011/0056714 | A1 | 3/2011 | Elger et al. | |
| 2012/0304836 | A1 | 12/2012 | Haman | |
| 2012/0322605 | A1 | 12/2012 | Hirabayashi | |
| 2012/0325509 | A1 | 12/2012 | Puzio et al. | |

* cited by examiner

TOOLS WITH SOCKET RETAINERS

TECHNICAL FIELD

The present disclosure relates, generally, to tools and, more particularly, to tools with socket retainers.

BACKGROUND

Tools for tightening and loosening fasteners are often used with interchangeable sockets that may be removably coupled to the tools (the sockets being configured to mate with the differently sized heads of various fasteners). Such tools may include an output shaft having a socket mount configured to transfer torque to a socket removably coupled to the socket mount and a socket retainer coupled to the socket mount to selectively secure the socket to the socket mount. During the operation of such tools, torque applied to the socket via the socket mount may cause stress to be maximized in the socket mount. Failure of the socket mount may occur when too much stress is developed in the socket mount.

SUMMARY

According to one aspect, an impact tool may comprise a hammer configured to rotate about an axis, an anvil including (i) an impact jaw configured to be periodically impacted by the hammer to cause rotation of the anvil about the axis and (ii) an output shaft including a socket mount configured to transfer the rotation of the anvil to a socket removably coupled to the socket mount, the socket mount including a tip and a solid root, the solid root being located between the tip and the impact jaw along the axis, and a socket retainer including (i) a retaining pin coupled to the tip of the socket mount and configured to move perpendicularly to the axis between a releasing position in which the retaining pin is located entirely within a first space formed in the tip and a retaining position in which the retaining pin extends outwardly through a first aperture formed in the tip and opening to the first space and (ii) a release pin coupled to the tip of the socket mount and configured to move along the axis to cause the retaining pin to move between the releasing position and the retaining position.

In some embodiments, the tip of the socket mount may be formed to include a second space that extends along the axis between a proximal end of the tip and a distal end of the tip, the proximal end of the tip being spaced apart from the distal end of the tip along the axis, the second space receiving the release pin of the socket retainer. The solid root of the socket mount may have a solid cross-section between a proximal end of the solid root and a distal end of the solid root, the proximal end of the solid root being spaced apart from the distal end of the solid root along the axis.

In some embodiments, the solid root of the socket mount has a root thickness measured along the axis between the proximal and distal ends of the solid root, the tip of the socket mount may have a tip thickness measured along the axis between the proximal and distal ends of the tip, and a ratio of the root thickness to the tip thickness may be greater than 0.9. In other embodiments, the ratio of the root thickness to the tip thickness may be less than 1.1. In still other embodiments, the ratio of the root thickness to the tip thickness may be about 0.95.

In some embodiments, the release pin may include an outer section configured to extend out of a second aperture formed in the distal end of the tip and opening to the second space, an inner section spaced apart from the outer section of the release pin along the axis, and a middle section located between the inner and outer sections of the release pin. The retaining pin may include an outer section configured to extend out of the first aperture when the retaining pin is in the retaining position, an inner section spaced apart from the outer section in a direction perpendicular to the axis, and a middle section located between the inner and outer sections of the retaining pin and formed to include a passageway that receives the release pin.

In some embodiments, the socket retainer may further include a spring configured to bias the retaining pin toward the retaining position. The spring may be located in the first space between the inner section of the retaining pin and an outer surface of the socket mount. The first space may be configured to extend from an outer surface of the tip in which the first aperture is formed, through the second space, and toward a floor located between the axis and the outer surface of the tip. Both the tip and the solid root of the socket mount may be configured to be received by a socket when the socket is removably coupled to the socket mount.

According to another aspect, a tool may comprise an output shaft configured to rotate about an axis, the output shaft including a socket mount configured to transfer rotation to a socket removably coupled to the socket mount, the socket mount including a tip and a solid root, and a socket retainer including (i) a retaining pin coupled to the tip of the socket mount and configured to move perpendicularly to the axis between a releasing position in which the retaining pin is located entirely within a first space formed in the tip and a retaining position in which the retaining pin extends outwardly through a first aperture formed in the tip and opening to the first space and (ii) a release pin coupled to the tip of the socket mount and configured to move along the axis to cause the retaining pin to move between the releasing position and the retaining position.

In some embodiments, the solid root may have a root thickness measured parallel to the axis, the tip may have a tip thickness measured parallel to the axis, and a ratio of the root thickness to the tip thickness may be between 0.95 and 1.05. The tip may be formed to include a second space that receives the release pin, the second space extending along the entire tip thickness. The solid root may have a solid cross-section along the entire root thickness. Both the tip and the solid root of the socket mount may be configured to be received by a socket when the socket is removably coupled to the socket mount. The retaining pin may be formed to include a passageway configured to receive the retaining pin.

According to yet another aspect, apparatus may comprise a socket including a floor having a central void formed therein and a side wall extending away from the floor, and a wrench comprising an output shaft configured to rotate about an axis, the output shaft including a socket mount configured to be received in the void formed in the floor of the socket. The wrench may further comprise a socket retainer including (i) a retaining pin coupled to the socket mount and configured to move perpendicularly to the axis between a releasing position and a retaining position and (ii) a release pin coupled to the socket mount and configured to move along the axis to cause the retaining pin to move between the releasing position and the retaining position. When the retaining pin is in the releasing position, the retaining pin may be located within a first space formed in the socket mount such that the retaining pin does not impede movement of the socket along the axis. When the socket mount is received in the void formed in the floor of the socket and the retaining pin is in the retaining position, the retaining pin may extend outwardly through a first aperture formed in the socket mount and opening to the first space such that the retaining pin engages the floor of the socket to impede movement of the socket along the axis.

In some embodiments, the socket mount may include a solid root having a root thickness measured parallel to the axis and a tip having a tip thickness measured parallel to the axis, the tip being formed to include a second space that extends along the entire tip thickness and receives the release pin. A ratio of the root thickness to the tip thickness may be between 0.95 and 1.05.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION OF THE DRAWINGS

Figure 1:
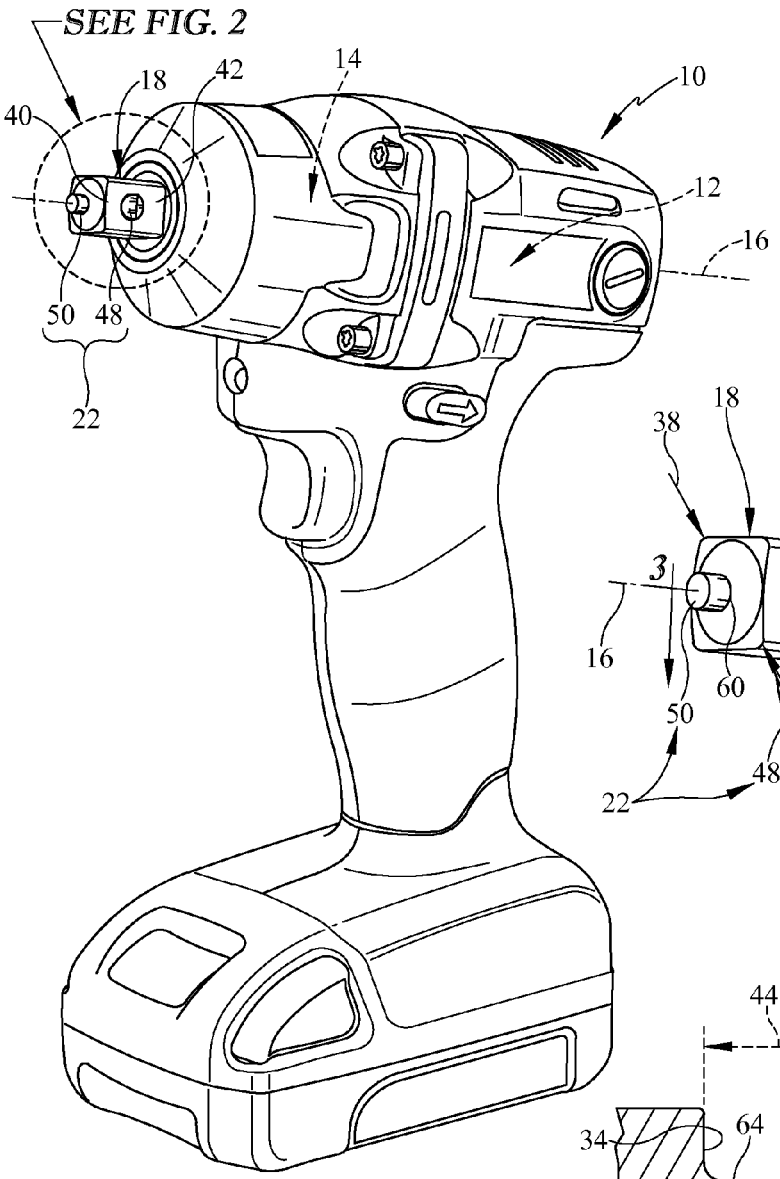
FIG. 1 is a perspective view of one illustrative embodiment of an impact tool including a socket retainer.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

One illustrative embodiment of a tool 10 including a socket mount 18 and a socket retainer 22 is shown in a perspective view in FIG. 1. The tool 10 is illustratively embodied as a cordless impact tool 10 including a motor 12, an impact mechanism 14 driven by the motor 12, and an output shaft 30 (including the socket mount 18) driven for rotation about an axis 16 by the impact mechanism 14. As described further below, the socket mount 18 of the impact tool 10 is configured to mate with a socket 20 (see, e.g., FIGS. 9-11) to transfer rotation to the socket 20. The socket retainer 22 of the impact tool 10 is located in the socket mount 18 and configured to selectively secure the socket 20 to the socket mount 18 for rotation therewith about the axis 16.

The motor 12 of the impact tool 10 may be embodied as an electric motor, a pneumatic motor, or any other suitable type of prime mover (the motor 12 being illustratively shown as an electric motor 12 in FIG. 1). In the illustrative embodiment of FIG. 1, the impact mechanism 14 of the impact tool 10 is of the type commonly known as a "ball-and-cam" impact mechanism 14 (see FIG. 4). U.S. Pat. No. 2,160,150 to Jimerson et al. (the entire disclosure of which is hereby incorporated by reference) describes at least one embodiment of such a ball-and-cam impact mechanism. In other illustrative embodiments, the impact mechanism of the impact tool 10 may instead be embodied as a "swinging-weight" type impact mechanism 114 (see FIG. 5), such as those disclosed in U.S. Pat. No. 3,661,217 to Maurer (the entire disclosure of which is hereby incorporated by reference), by way of example. In still other illustrative embodiments, the impact tool 10 may include any other suitable impact mechanism. Further, it is also contemplated that the principles of the present disclosure may be implemented within other tools (i.e., not including impact mechanisms), including other types of power tools and manually operated tools.

Figure 3:
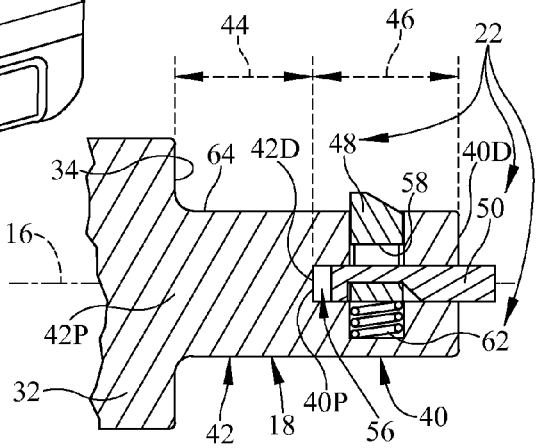
FIG. 3 is a sectional view taken along line 3-3 of FIG. 2.
Figure 4:
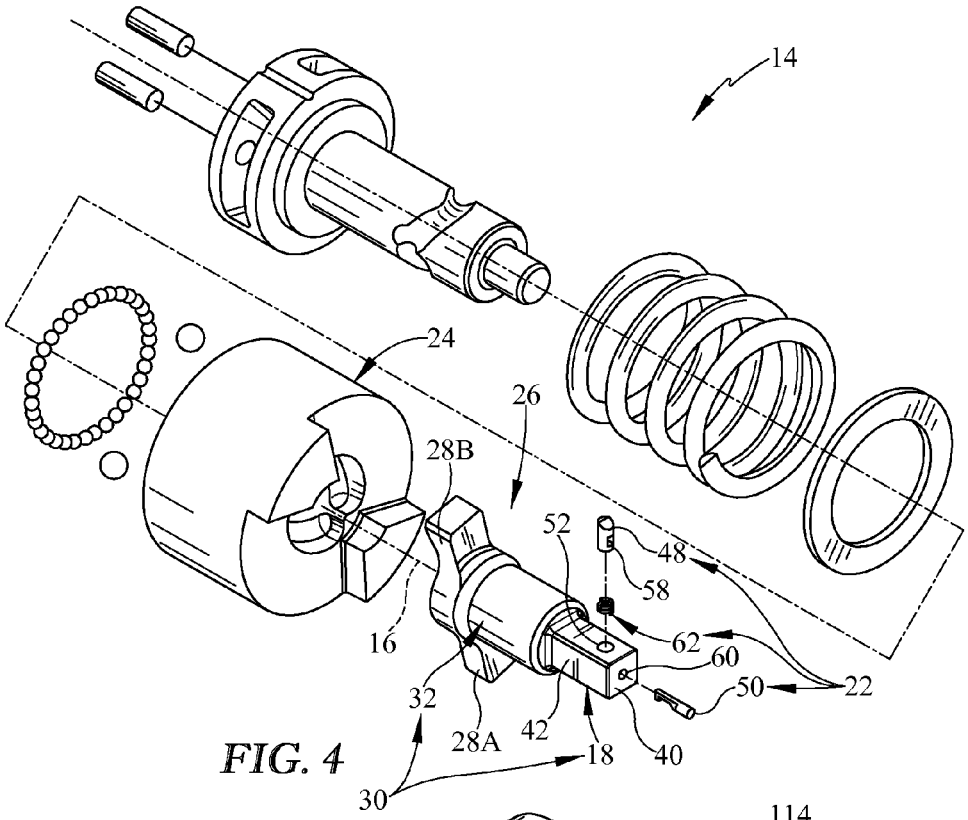
FIG. 4 is an exploded assembly view of selected components of an impact mechanism of the impact tool of FIG. 1.

The impact mechanism 14 of the illustrative embodiment is shown in greater detail in the exploded assembly view of FIG. 4 (only selected components of the impact mechanism 14 being shown). The impact mechanism 14 includes a hammer 24 configured to rotate about the axis 16 and an anvil 26 configured to rotate about the axis 16 in response to periodic impacts from the hammer 24. In the illustrative embodiment shown in FIGS. 1-4, the socket mount 18 is integrally formed as part of the anvil 26.

The anvil 26 includes the output shaft 30 and impact jaws 28A, 28B, as shown in FIG. 4. The impact jaws 28A, 28B are coupled to the output shaft 30 and extend away from the output shaft 30 in a direction generally perpendicular to the axis 16. The impact jaws 28A, 28B of the anvil 26 are configured to be periodically impacted by corresponding impact jaws of the hammer 24, as the hammer 24 rotates about and translates along the axis 16. These impact blows cause the anvil 26 (and, hence, output shaft 30) to rotate about the axis 16. This rotation will be transferred to a socket 20 engaged with the socket mount 18 of the output shaft 30.

Figure 2:
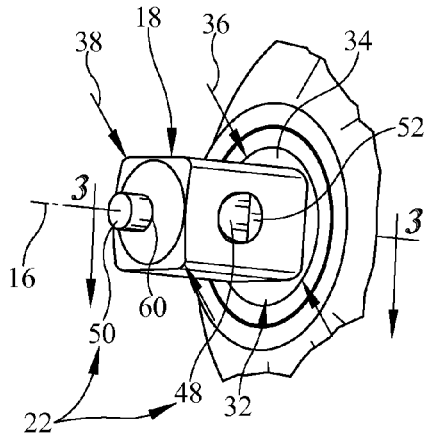
FIG. 2 is an enlarged partial perspective view taken from the circled region of FIG. 1.

The output shaft 30 includes the socket mount 18 and a jaw mount 32, as shown in FIG. 4. The impact jaws 28A, 28B are coupled to a proximal end of the jaw mount 32 and extend away from the jaw mount 32 in a direction generally perpendicular to the axis 16. The jaw mount 32 includes a distal surface 34 located at the distal end of the jaw mount 32 and configured to face toward the socket 20, as shown in FIGS. 2-4. The socket mount 18 is coupled to the distal surface 34 of the jaw mount 32.

In the illustrative embodiment, the jaw mount 32 has a generally circular cross-section which has a diameter 36. In contrast, the socket mount 18 has a generally square cross-section, as best seen in FIG. 2. As a result, the square cross-section has a diagonal 38 extending between two opposite corners of the square cross-section that is longer than any one side of the socket mount 18. In the illustrative embodiment, the diagonal 38 of the socket mount 18 is smaller than the diameter 36 of the jaw mount 32, as suggested in FIGS. 2 and 3. It is contemplated that, in other embodiments, the socket mount 18 may have other cross-sections adapted to mate with appropriate sockets 20, including, but not limited to, other polygonal cross-sections.

The socket mount 18 includes a tip 40 and a solid root 42, as shown in FIG. 3. The tip 40 is spaced apart from the distal surface 34 of the jaw mount 32 and coupled to the solid root 42. The solid root 42 is coupled to the distal surface 34 of the jaw mount 32 and extends between and interconnects the jaw mount 32 and the tip 40, as shown in FIG. 3. As shown in FIG. 3 (as well as in FIGS. 6-16), the solid root 42 has a cross-section which is solid along the axis 16.

The solid root 42 of the socket mount 18 has a proximal end 42P and a distal end 42D, as shown in FIG. 3. The solid root 42 is coupled to the distal surface 34 of the jaw mount 32 at the proximal end 42P of the solid root 42. The tip 40 of the socket mount 18 is coupled to the solid root 42 at the distal end 42D of the solid root 42. The solid root 42 extends between the proximal and distal ends 42P, 42D. The solid root 42 has a root thickness 44, which is measured along the axis 16 between the distal end 42D and the proximal end 42P of the solid root 42, as shown in FIG. 3.

The tip 40 of the socket mount 18 has a proximal end 40P and a distal end 40D, as shown in FIG. 3. The tip 40 is coupled to the distal end 42D of the solid root 42 at the proximal end 40P of the tip 40. The tip 40 extends between the proximal end 40P and the distal end 40D of the tip 40. The tip 40 has a tip thickness 46, which is measured along the axis 16 between the distal end 40D and the proximal end 40P of the tip 40, as shown in FIG. 3.

In one illustrative example, a ratio of the root thickness 44 to the tip thickness 46 is greater than about 0.9. In another illustrative example, the ratio of the root thickness 44 to the tip thickness 46 is greater than about 0.9 and less than about 1.1. In still another illustrative example, the ratio of the root thickness 44 to the tip thickness 46 is about 0.95. During the transmission of torque from the anvil 26 to the socket 20, stress is created in the socket mount 18. As the solid root 42 has a solid cross-section (whereas, the tip 40 does not, as further described below), the solid root 42 is able to bear much of the stress created in the socket mount 18. The increased root thickness 44, as compared to other socket mounts, allows the solid root 42 (having the solid cross-section) to extend further into the socket 20 and will typically result in an extended service life for the socket mount 18.

Figure 9:
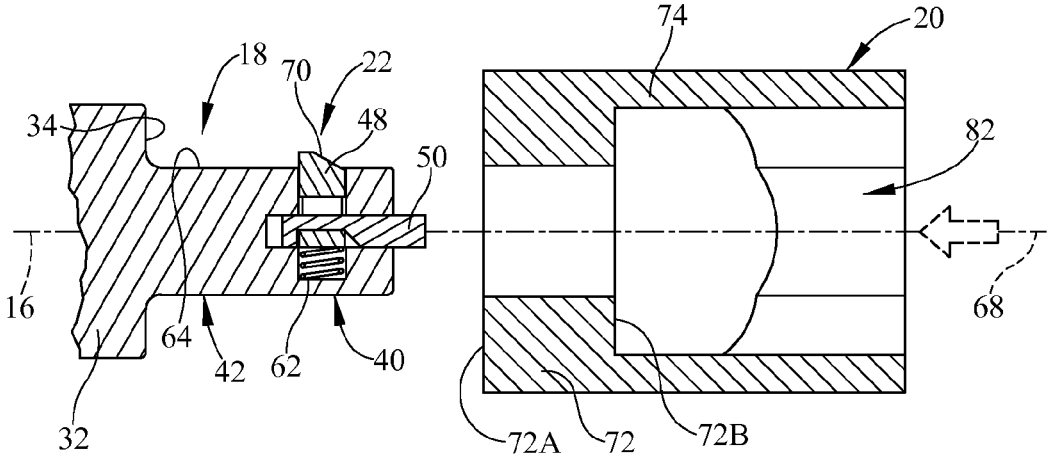
FIG. 9 is a sectional view similar to FIG. 3, showing one operation included in an illustrative socket-installation process.
Figure 11:
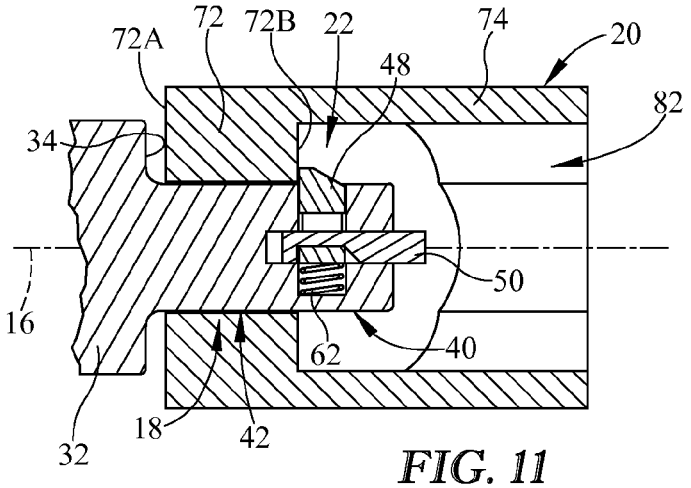
FIG. 11 is a sectional view similar to FIG. 3, showing yet another operation included in the illustrative socket-installation process.
Figure 16:
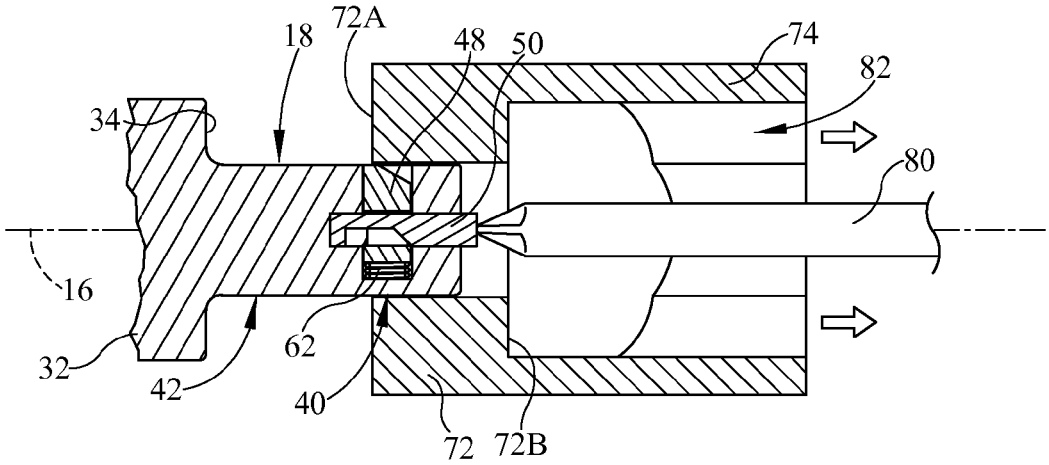
FIG. 16 is a sectional view similar to FIG. 3, showing yet another operation included in the illustrative socket-removal process.

The socket retainer 22 is located in the tip 40 of the socket mount 18 and is configured to selectively secure the socket 20 to the output shaft 30 for rotation therewith. The socket retainer 22 includes a retaining pin 48 and a release pin 50, as shown in FIGS. 2 and 3. The retaining pin 48 is coupled to the tip 40 of the socket mount 18. In the illustrative embodiment, the retaining pin 48 is configured to move perpendicularly to the axis 16 between a retaining position, as shown in FIGS. 9 and 11, and a releasing position, as shown in FIG. 16. The release pin 50 is received in a space 56 formed in the tip 40. In the illustrative embodiment, the release pin 50 is configured to move along the axis 16 to cause the retaining pin 48 to move between the retaining position and the releasing position. As shown in FIG. 16, the retaining pin 48 may located entirely within a space 54 formed in the tip 40 when in the releasing position. The retaining pin 48 is configured to extend outwardly through an aperture 52 that opens to the space 54, when the retaining pin 48 is in the retaining position.

Figure 6:
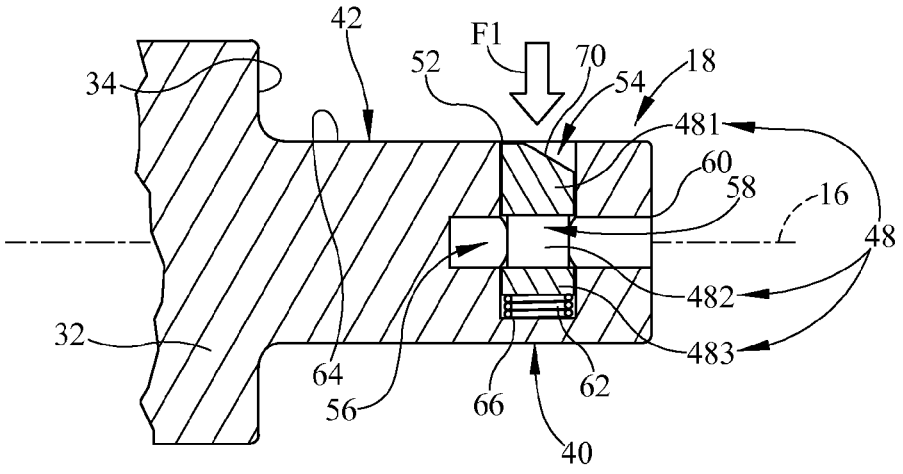
FIG. 6 is a sectional view similar to FIG. 3, showing one operation included in an illustrative assembly process for the socket retainer.
Figure 7:
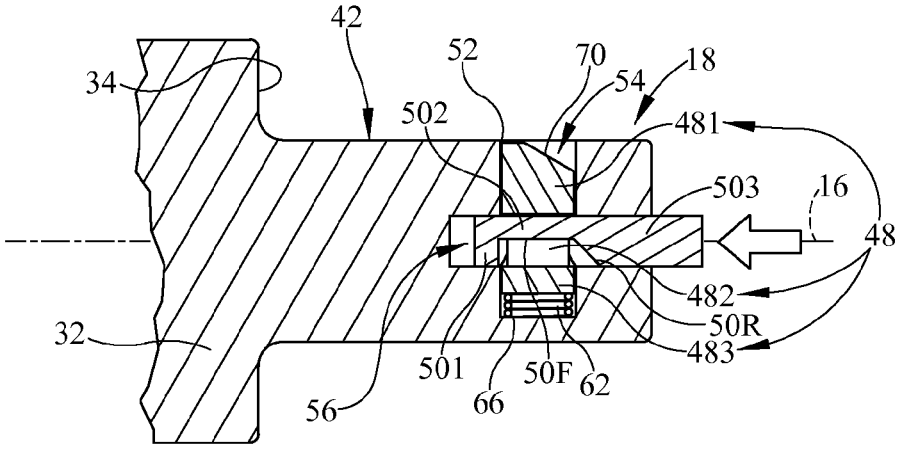
FIG. 7 is a sectional view similar to FIG. 3, showing another operation included in the illustrative assembly process for the socket retainer.
Figure 8:
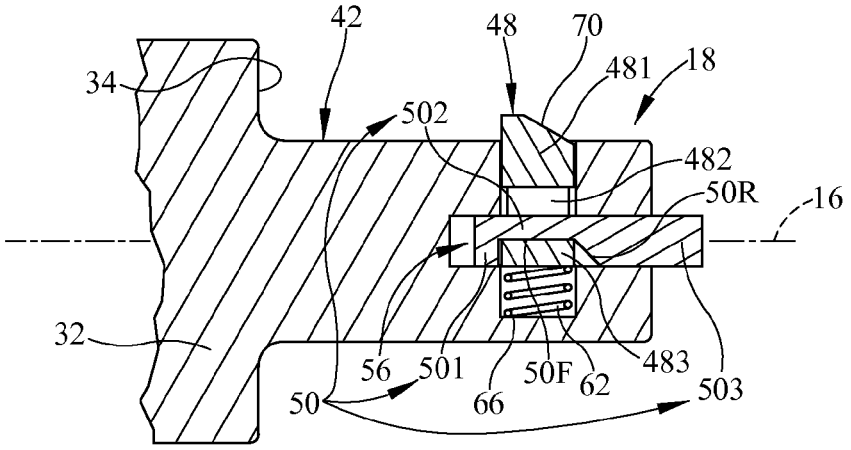
FIG. 8 is a sectional view similar to FIG. 3, showing yet another operation included in the illustrative assembly process for the socket retainer.

The retaining pin 48 of the socket retainer 22 includes an outer section 481, a middle section 482, and an inner section 483, as shown in FIGS. 6-8. The outer section 481 extends out of the aperture 52 when the socket retainer 22 is in the retaining position. The inner section 483 is spaced apart from the outer section 481 along a direction perpendicular to the axis 16. The middle section 482 is located between the inner and outer sections 481, 483 and is formed to include a passageway 58 extending therethrough. As shown in FIGS. 7 and 8, the release pin 50 extends through the passageway 58 formed in the retaining pin 48.

The release pin 50 includes an inner section 501, a middle section 502, and an outer section 503, as shown in FIGS. 7 and 8. The inner section 501 is located in the space 56 formed in the tip 40 of the socket mount 18. The outer section 503 is spaced apart from the inner section 501 and extends out of an aperture 60 formed in the distal end 40D of the tip 40. The aperture 60 is aligned with the axis 16 and opens to the space 56. The middle section 502 extends between and interconnects the inner and outer sections 501, 503, as shown in FIGS. 7 and 8.

Figure 14:
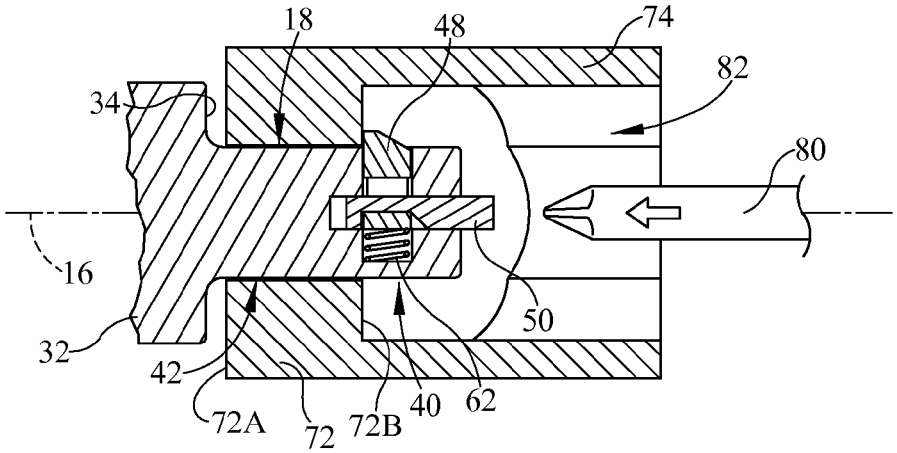
FIG. 14 is a sectional view similar to FIG. 3, showing one operation included in an illustrative socket-removal process.
Figure 15:
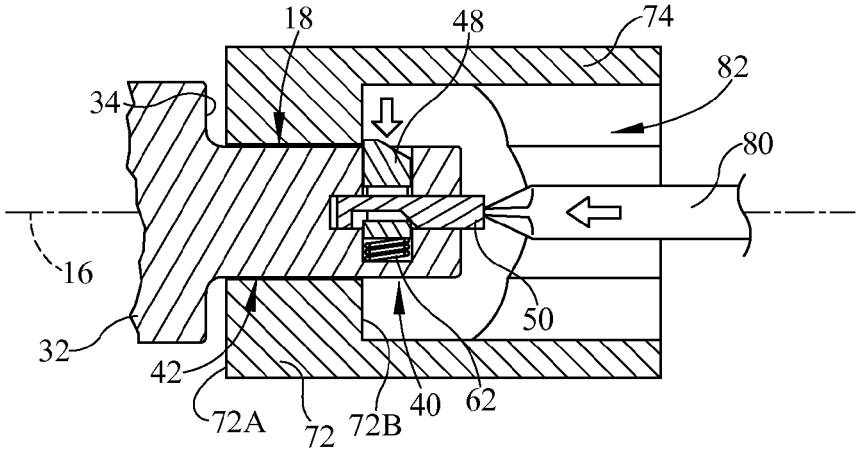
FIG. 15 is a sectional view similar to FIG. 3, showing another operation included in the illustrative socket-removal process.

The middle section 502 of the release pin 50 includes a flat surface 50F and a ramped surface 50R as shown, for example, in FIGS. 7 and 8. The ramped surface 50R is configured to engage and move the passageway 58 of the retaining pin 48, as shown in FIGS. 14-16. During removal of the socket 20 from the socket mount 18, a user applies a force to the release pin 50 causing the ramped surface 50R to engage the passageway 58 and move the outer section 481 of the retaining pin 48 toward the axis 16, as shown in FIGS. 15 and 16. When the retaining pin 48 is in the retaining position, the flat surface 50F of the middle section 402 engages the passageway 58 formed in the middle section 482 of the retaining pin 48, as shown in FIGS. 11 and 14.

As shown in FIGS. 4-8, the socket retainer 22 further includes a spring 62. The spring 62 is configured to bias the retaining pin 48 toward the retaining position, as suggested in FIG. 8. The spring 62 is located in the space 54 between the inner section 483 of the retaining pin 48 and an outer surface 64 of the socket mount 18, as shown in FIGS. 6-8.

The space 56 formed in the tip 40 of the socket mount 18 extends along the axis 16 between the proximal end 40P of the tip 40 and the distal end 40D of the tip 40 (i.e., the entire tip thickness 46). The space 54 extends from the outer surface 64 of the socket mount 18 (in which the aperture 52 is formed), through the space 56, and toward a floor 66, as shown in FIGS. 6-8. The floor 66 is located between the axis 16 and the outer surface 64 of the tip 40.

One illustrative embodiment of an assembly process for the socket retainer 22 is shown in FIGS. 6-8. Initially, the spring 62 is positioned in the space 56 and the retaining pin 48 is located in the space 54 to trap the spring 62 between the inner section 483 of the retaining pin 48 and the floor 66, as shown in FIG. 6. A force F1 is then applied to the retaining pin 48 to cause the spring 62 to be compressed and the passageway 58 formed in the middle section 482 of the retaining pin 48 to be generally aligned with the space 56 along the axis 16. Next, the release pin 50 is slid through the aperture 52 into the space 56 and through the passageway 58, as shown in FIG. 7. Finally, the force F1 is removed, and the spring 62 urges the retaining pin 48 into the retaining position, as shown in FIG. 8.

Figure 10:
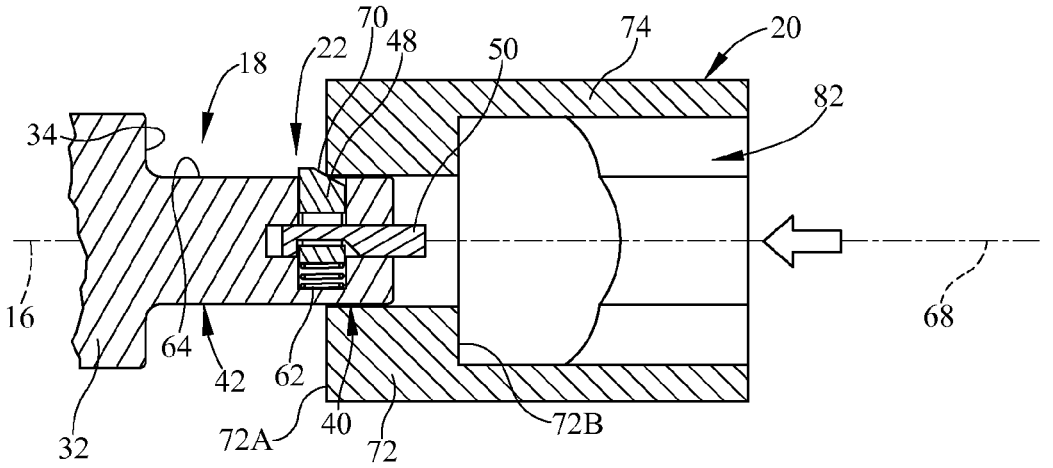
FIG. 10 is a sectional view similar to FIG. 3, showing another operation included in the illustrative socket-installation process.

The socket 20 may be installed on socket mount 18 in a socket-installation process as shown, by way of illustrative example, in FIGS. 9-11. Initially, a socket axis 68 of the socket 20 is aligned with the axis 16, as shown in FIG. 9. Next, a user moves the socket 20 toward and into engagement with the socket mount 18, as shown in FIG. 10. This causes the socket 20 to engage a cam surface 70 of the outer section 481 of the retaining pin 48 to move the retaining pin 48 into the space 54 formed in the tip 40. As the user continues to move the socket 20 toward the distal surface 34 of the jaw mount 32, the spring 62 will urge the retaining pin 48 outwardly to trap a portion of the socket 20 between the retaining pin 48 and the distal surface 34. Once in this retaining position, the retaining pin 48 will block unintended movement of the socket 20 along the axis 16 (relative to the socket mount 18).

As shown in FIGS. 9-11, one illustrative embodiment of the socket 20 includes a floor 72 and a side wall 74. The floor 72 includes a first surface 72A configured to face toward the distal surface 34 of the jaw mount 32 and a second surface 72B configured to face away from the distal surface 34. The side wall 74 is coupled to the second surface 72B of the floor 72 and extends away from the second surface 72B along the socket axis 68. In this illustrative embodiment, the floor 72 of the socket 20 has a relatively greater thickness than a thickness of the side wall 74. As such, when the socket 20 is installed on the socket mount 18 and the retaining pin 48 is in the retaining position, the outer section 481 of the retaining pin 48 engages the second surface 72B of the floor 72, as shown in FIG. 11.

Figure 12:
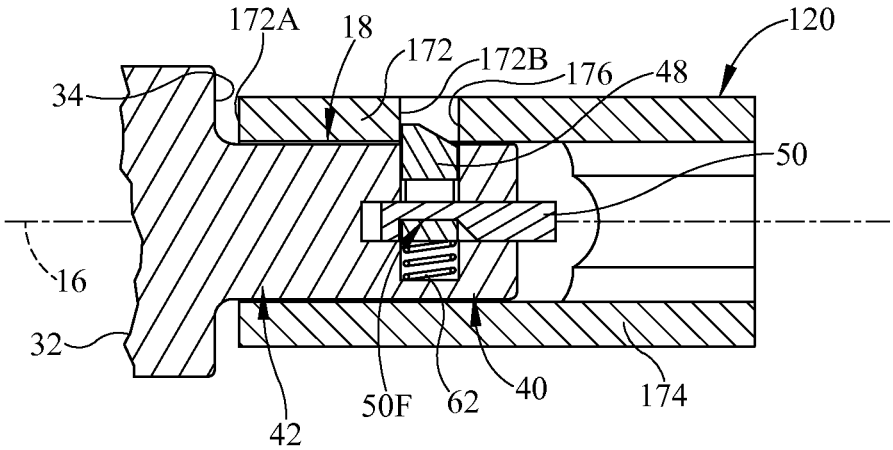
FIG. 12 is a sectional view similar to FIG. 3 of another illustrative embodiment of a socket that may be used with the presently disclosed socket retainers.

Another illustrative embodiment of a socket 120 that may be used with the socket retainers 22 of the present disclosure is shown, for example, in FIG. 12. The socket 120 includes a floor 172 and a side wall 174. The floor 172 includes a first surface 172A configured to face toward the distal surface 34 of the jaw mount 32 and a second surface 172B configured to face away from distal surface 34. In this illustrative embodiment, the second surface 172B is formed in an aperture 176 formed in the side wall 174. As a result, the floor 172 and the side wall 174 have roughly the same thickness in this illustrative embodiment.

Figure 13:
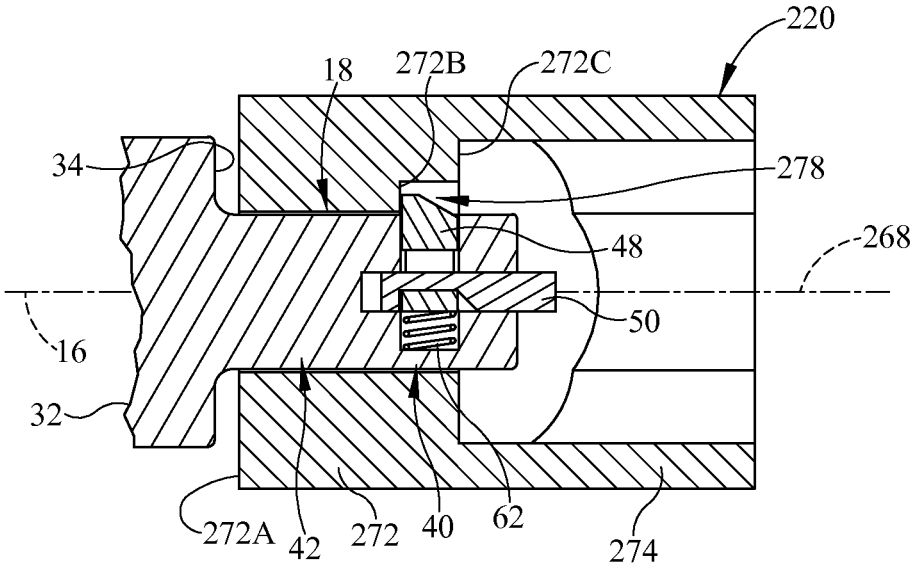
FIG. 13 is a sectional view similar to FIG. 3 of yet another illustrative embodiment of a socket that may be used with the presently disclosed socket retainers.

Yet another illustrative embodiment of a socket 220 that may be used with the socket retainers 22 of the present disclosure is shown, for example, in FIG. 13. The socket 220 includes a floor 272 and a side wall 274 extending away from the floor 272 along the socket axis 268. The floor 272 includes a first surface 272A configured to face toward the distal surface 34 of the jaw mount 32 and a second surface 272B configured to face away from the distal surface 34 of the jaw mount 32. The second surface 272B is established as a result of forming a pin-receiving space 278 in the floor 272, as shown in FIG. 13. The floor 272 further includes a third surface 272C which is spaced apart along the socket axis 268 from the first surface 272A and the second surface 272B (with the second surface 272B being located between the first and third surfaces 272A, 272C along the socket axis 268).

One illustrative embodiment of a socket-removal process is shown, for example, in FIGS. 14-16. Initially, as shown in FIG. 14, a user inserts a tip of another tool 80 or other object (e.g., a finger) into a socket space 82 and aligns the tip with the axis 16. The user then moves the tip toward the release pin 50 to engage and move the release pin 50 along the axis 16 toward the distal surface 34 of the jaw mount 32. As the release pin 50 moves toward the distal surface 34, the ramped surface 50R of the middle portion 502 of the release pin 50 engages the passageway 58 formed in the retaining pin 48, causing the retaining pin 48 to move away from the side wall 74 of the socket 20 until the retaining pin 48 moves to the releasing position, as shown in FIG. 15. Finally, the socket 20 is moved away from the distal surface 34 of the jaw mount 32 past the retaining pin 48 to free the socket 20, as suggested in FIG. 16.

Figure 5:
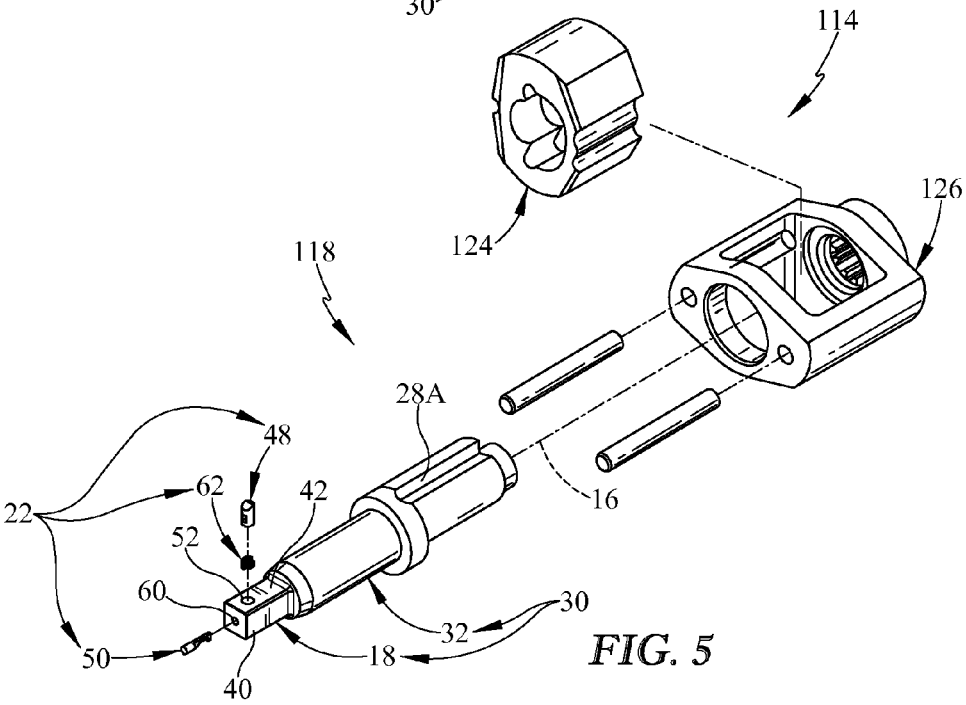
FIG. 5 is an exploded assembly view of selected components of another illustrative embodiment of an impact mechanism including a socket retainer.

Another embodiment of an impact mechanism 114 according to the present disclosure is shown, for example, in FIG. 5. The impact mechanism 114 includes a hammer 124 supported by a hammer frame 126 that rotates about the axis 16. In this embodiment, as the hammer 124 rotates about the axis 16, the hammer 124 also pivots relative to the hammer frame 126. The impact mechanism 114 further includes an anvil 118 configured to rotate about the axis 16 in response to periodic impacts from the hammer 124. In the illustrative embodiment of FIG. 5, the anvil 118 is integrally formed with the socket mount 18. The anvil 118 includes the socket mount 18 and the socket retainer 22. The design and function of the socket mount 18 and the socket retainer 22 may be substantially the same as described above (in relation to the anvil 26 of FIG. 4) when used with the anvil 118 of FIG. 5. Furthermore, the presently disclosed socket mounts 18 and socket retainers 22 may be incorporated into the outputs of any number of tools that are adapted to operate with interchangeable sockets, including other types of power tools and manually operated tools (e.g., wrenches).

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. An impact tool comprising:

a hammer configured to rotate about an axis;

an anvil including (i) an impact jaw configured to be periodically impacted by the hammer to cause rotation of the anvil about the axis and (ii) an output shaft including a socket mount configured to transfer the rotation of the anvil to a socket removably coupled to the socket mount, the socket mount including a tip and a solid root, the solid root being located between the tip and the impact jaw along the axis; and a socket retainer including (i) a retaining pin coupled to the tip of the socket mount and configured to move perpendicularly to the axis between a releasing position in which retaining pin is located entirely within a first space formed in the tip and a retaining position in which the retaining pin extends outwardly through a first aperture formed in the tip and opening to the first space and (ii) a release pin coupled to the tip of the socket mount and configured to move along the axis to cause the retaining pin to move between the releasing position and the retaining position;

wherein the tip of the socket mount is formed to include a second space that extends along the axis between a proximal end of the tip and a distal end of the tip, the proximal end of the tip being spaced apart from the distal end of the tip along the axis, the second space receiving the release pin of the socket retainer; and wherein the release pin includes an outer section configured to extend out of a second aperture formed in the distal end of the tip and opening to the second space, an inner section spaced apart from the outer section of the release pin along the axis, and a middle section located between the inner and outer sections of the release pin.

2. The impact tool of claim 1, wherein the solid root of the socket mount has a solid cross-section between a proximal end of the solid root and a distal end of the solid root, the proximal end of the solid root being spaced apart from the distal end of the solid root along the axis.

3. The impact tool of claim 2, wherein:

the solid root of the socket mount has a root thickness measured along the axis between the proximal and distal ends of the solid root;

the tip of the socket mount has a tip thickness measured along the axis between the proximal and distal ends of the tip; and a ratio of the root thickness to the tip thickness is greater than 0.9.

4. The impact tool of claim 3, wherein the ratio of the root thickness to the tip thickness is less than 1.1.

5. The impact tool of claim 4, wherein the ratio of the root thickness to the tip thickness is about 0.95.

6. The impact tool of claim 1, wherein the retaining pin includes an outer section configured to extend out of the first aperture when the retaining pin is in the retaining position, an inner section spaced apart from the outer section in a direction perpendicular to the axis, and a middle section located between the inner and outer sections of the retaining pin and formed to include a passageway that receives the release pin.

7. The impact tool of claim 6, wherein the socket retainer further includes a spring configured to bias the retaining pin toward the retaining position.

8. The impact tool of claim 7, wherein the spring is located in the first space between the inner section of the retaining pin and an outer surface of the socket mount.

9. The impact tool of claim 1, wherein the first space is configured to extend from an outer surface of the tip in which the first aperture is formed, through the second space, and toward a floor located between the axis and the outer surface of the tip.

10. The impact tool of claim 1, wherein both the tip and the solid root of the socket mount are configured to be received by a socket when the socket is removably coupled to the socket mount.

11. A tool comprising:

an output shaft configured to rotate about an axis, the output shaft including a socket mount configured to transfer rotation to a socket removably coupled to the socket mount, the socket mount including a tip and a solid root; and a socket retainer including (i) a retaining pin coupled to the tip of the socket mount and configured to move perpendicularly to the axis between a releasing position in which the retaining pin is located entirely within a first space formed in the tip and a retaining position in which the retaining pin extends outwardly through a first aperture formed in the tip and opening to the first space and (ii) a release pin coupled to the tip of the socket mount and configured to move along the axis to cause the retaining pin to move between the releasing position and the retaining position;

wherein the tip of the socket mount is formed to include a second space that extends along the axis between a proximal end of the tip and a distal end of the tip, the proximal end of the tip being spaced apart from the distal end of the tip along the axis, the second space receiving the release pin of the socket retainer; and wherein the release pin includes an outer section configured to extend out of a second aperture formed in the distal end of the tip and opening to the second space, an inner section spaced apart from the outer section of the release pin along the axis, and a middle section located between the inner and outer sections of the release pin.

12. The tool of claim 11, the solid root has a root thickness measured parallel to the axis, the tip has a tip thickness measured parallel to the axis, and a ratio of the root thickness to the tip thickness is between 0.95 and 1.05.

13. The tool of claim 12, wherein the tip is formed to include a second space that receives the release pin, the second space extending along the entire tip thickness.

14. The tool of claim 13, wherein the solid root has a solid cross-section along the entire root thickness.

15. The impact tool of claim 14, wherein both the tip and the solid root of the socket mount are configured to be received by a socket when the socket is removably coupled to the socket mount.

16. The tool of claim 11, wherein the retaining pin is formed to include a passageway configured to receive the retaining pin.

17. Apparatus comprising:

a socket including a floor having a central void formed therein and a side wall extending away from the floor; and a wrench comprising an output shaft configured to rotate about an axis, the output shaft including a socket mount configured to be received in the void formed in the floor of the socket, the wrench further comprising a socket retainer including (i) a retaining pin coupled to the socket mount and configured to move perpendicularly to the axis between a releasing position and a retaining position and (ii) a release pin coupled to the socket mount and configured to move along the axis to cause the retaining pin to move between the releasing position and the retaining position;

wherein, when the retaining pin is in the releasing position, the retaining pin is located within a first space formed in the socket mount such that the retaining pin does not impede movement of the socket along the axis and, when the socket mount is received in the void formed in the floor of the socket and the retaining pin is in the retaining position, the retaining pin extends outwardly through a first aperture formed in the socket mount and opening to the first space such that the retaining pin engages the floor of the socket to impede movement of the socket along the axis;

wherein the tip of the socket mount is formed to include a second space that extends along the axis between a proximal end of the tip and a distal end of the tip, the proximal end of the tip being spaced apart from the distal end of the tip along the axis, the second space receiving the release pin of the socket retainer; and wherein the release pin includes an outer section configured to extend out of a second aperture formed in the distal end of the tip and opening to the second space, an inner section spaced apart from the outer section of the release pin along the axis, and a middle section located between the inner and outer sections of the release pin.

18. The tool of claim 17, wherein the socket mount includes a solid root having a root thickness measured parallel to the axis and a tip having a tip thickness measured parallel to the axis, the tip being formed to include a second space that extends along the entire tip thickness and receives the release pin, a ratio of the root thickness to the tip thickness being between 0.95 and 1.05.

* * * * *